US008851564B2

(12) United States Patent
Seo

(10) Patent No.: US 8,851,564 B2
(45) Date of Patent: Oct. 7, 2014

(54) CHAIR WITH FOLDABLE DESK

(76) Inventor: Won ho Seo, Sihung (KR)

( * ) Notice: Subject to any disclaimer, the term of this patent is extended or adjusted under 35 U.S.C. 154(b) by 355 days.

(21) Appl. No.: 13/300,065

(22) Filed: Nov. 18, 2011

(65) Prior Publication Data

US 2012/0126587 A1 May 24, 2012

(30) Foreign Application Priority Data

Nov. 19, 2010 (KR) ..... 10-2010-0115387

(51) Int. Cl.
*A47B 39/00* (2006.01)
*A47C 7/70* (2006.01)

(52) U.S. Cl.
CPC ..... *A47C 7/70* (2013.01)
USPC ..... 297/162; 297/160; 297/161; 297/167; 297/173; 297/287; 297/291; 297/294; 297/313; 297/331

(58) Field of Classification Search
CPC ..... A47C 7/70; A47C 1/21; A47C 3/045; A47B 83/02
USPC ..... 297/160–162, 167, 169, 170, 173, 297/287–289, 291, 293, 294, 313, 311, 331, 297/336
See application file for complete search history.

(56) References Cited

U.S. PATENT DOCUMENTS 4,603,904 A * 8/1986 Tolleson et al. ..... 297/296
4,869,552 A * 9/1989 Tolleson et al. ..... 297/296
5,108,149 A * 4/1992 Ambasz ..... 297/342
5,904,397 A * 5/1999 Fismen ..... 297/291
5,909,864 A * 6/1999 Wang ..... 248/289.11
6,073,997 A * 6/2000 Koh ..... 297/173
6,224,149 B1 * 5/2001 Gevaert ..... 297/162
6,669,282 B2 * 12/2003 Piretti ..... 297/162
6,742,839 B2 * 6/2004 Piretti ..... 297/239
6,755,468 B1 * 6/2004 Pan ..... 297/335
7,147,286 B2 * 12/2006 Cesaroni et al. ..... 297/301.1
7,370,910 B2 * 5/2008 Piretti ..... 297/162
7,695,061 B2 * 4/2010 Olarte ..... 297/162
8,109,566 B2 * 2/2012 Koh ..... 297/145
8,282,166 B2 * 10/2012 Piretti ..... 297/294
8,540,315 B2 * 9/2013 Piretti ..... 297/335
2007/0284920 A1 * 12/2007 Mehaffey et al. ..... 297/162
2010/0090504 A1 * 4/2010 Brink et al. ..... 297/162
2011/0101740 A1 * 5/2011 Koh ..... 297/162

FOREIGN PATENT DOCUMENTS

JP 2005-245868 9/2005
KR 20-2010-0008027 8/2010
KR 10-2010-0115387 11/2010

* cited by examiner

*Primary Examiner* — Laurie Cranmer
(74) *Attorney, Agent, or Firm* — Arent Fox LLP

(57) ABSTRACT

A chair with a foldable desk includes a support leg having a crossbar. A seat plate installed above said support leg includes an upper seat, a lower cover and a coupler into which the crossbar is rotatably inserted. The seat plate rotates between a vertical position and a horizontal position. A back installed above a rear side of the seat plate is capable of tilting forward and rearward with tilting means. A desk installed above a side of the support leg includes an upper plate with an attachment member on its bottom. The upper plate may swing between an upper position and a lower position within an angle range.

2 Claims, 12 Drawing Sheets

CHAIR WITH FOLDABLE DESK

BACKGROUND OF THE INVENTION

1. Field of the Invention

The present invention relates to a chair with a foldable desk, and more particularly to a chair which enables the desk located above a side of the chair to be folded/unfolded by way of an upward/downward swing or a rotation on a horizontal plane and which enables the desk to be disassembled or assembled as necessary. Also, the present invention relates to the chair including such functions as back-tilting or seat plate folding, so that the productivity, the functionality, the economy and the convenience thereof can be improved.

2. Description of the Related Art

Generally, the chair comprises a support leg, a seat plate and a back. The chair has been manufactured in many ways in consideration of its functional aspect as well as the design aspect.

For instance, the foldable-seat plate structure and the tilting function of the backseat provide the user with the better comfort, along with the availability of space.

However, the conventional chair has a complex structure so as to take various functions into the consideration. Also, the degradation in the productivity and the economy is caused, because expensive parts are included therein.

In the prior art, a chair having a desk is disclosed, wherein the desk is fixed at its upper side of the chair so as to provide the function of the desk. The chair with the fixed desk improves the convenience, but it might cause the inconvenience when the desk is unnecessary. Also, it occupies too much space during carriage and storage.

SUMMARY OF THE INVENTION

Accordingly, the present invention has been made to solve the above-mentioned problems occurring in the prior art, and the present invention provides a chair with a foldable desk which meets the requirements regarding the design, the productivity, the economy and the convenience.

The object of the present invention provides a chair with a foldable desk, wherein the desk installed above at a side of the chair is folded or unfolded with the rotation of the desk on a horizontal plane and swing of the desk between an upper position and a lower position and wherein the desk is assembled to or disassembled from the chair. The chair according to the present invention provides the tilt operation of a back and the folding/unfolding operation of a seat plate, so that it can provides the maximized productivity, functionality and convenience.

According to an embodiment of the present invention, there is provided a chair with foldable desk, which comprises: a support leg having a crossbar; a seat plate installed above said support leg and including an upper seat, a lower cover and a coupler into which the crossbar is rotatably inserted, wherein the coupler is formed by upper and lower brackets, each of which has a semi-circular coupling groove to form a circular space for receiving the crossbar, wherein the coupler is formed with a long-guide holes extended in a rotational direction of the crossbar to receive support protrusions formed on the crossbar, and wherein the seat plate rotates between a vertical position and a horizontal position so as to be folded and unfolded; a back installed above a rear side of the seat plate and capable of tilting forward and rearward by means of tilting means, wherein the tilting means comprises a tension spring between upper and lower connectors, which are connected to the back and the support leg, respectively; and a desk installed above a side of the support leg and including an upper plate with an attachment member on its bottom, wherein the attachment member is formed with a coupling hole and a stop boss extending along a portion of an inner periphery of the coupling hole, wherein a joint formed with a support boss is inserted into the coupling hole to rotate therein, wherein the rotation of the joint is limited by the contact between the stop boss and the support boss to thereby limit the rotation of the upper plate on a horizontal plane, wherein the joint is formed with an assembling hole penetrating a cylindrical surface of the joint and an operation hole extending along a bottom and a portion the cylindrical surface of the joint, wherein an end of a coupler is inserted into the assembling hole of the joint so as to allow the joint to rotate about the coupler, while the other end of the coupler is connected to the connecting bar coupled to the support leg, wherein a stop bolt is inserted through the operating hole to be screwed to the coupler, so that the upper plate may swing between an upper position and a lower position within an angle range defined by the interaction in that the stop bolt is guided by the operating hole.

According to a feature of the present invention, the desk is detachably coupled to the chair in such a manner that a coupling bracket connected to an end of the connecting bar is releasably secured to a fixing bracket welded to a bent portion by means of bots, wherein the bent portion has a “>” shape and locates at a rear side of the support leg.

BRIEF DESCRIPTION OF THE DRAWINGS

The above and other aspects, features and advantages of the present invention will be more apparent from the following detailed description taken in conjunction with the accompanying drawings, in which.

DETAILED DESCRIPTION OF THE EXEMPLARY EMBODIMENT

Figure 1:
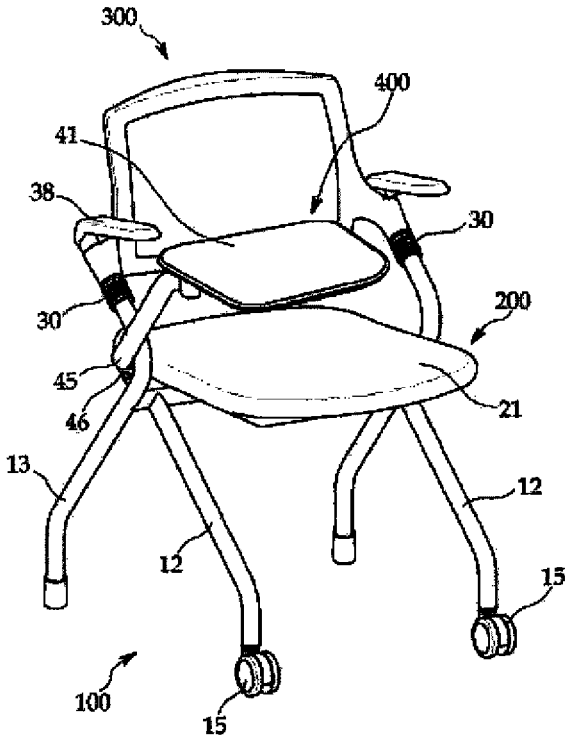
FIG. 1 is a perspective view of a chair with a foldable desk according to the present invention.

Hereinafter, exemplary embodiments of the present invention will be described with reference to the accompanying drawings. In the following description, the same elements will be designated by the same reference numerals although they are shown in different drawings. Further, various specific definitions found in the following description, such as specific values of packet identifications, contents of displayed information, etc., are provided only to help general understanding of the present invention, and it is apparent to those skilled in the art that the present invention can be implemented without such definitions. Further, in the following description of the present invention, a detailed description of known functions and configurations incorporated herein will be omitted when it may make the subject matter of the present invention rather unclear.

As illustrated in FIGS. 1-13, a chair with a foldable desk of the present invention comprises: a support legs 100; seat plate 200 installed above said support leg 100 and capable of being folded between a horizontal position and a vertical position; a back 300 installed above a rear side of said seat plate 200; and a desk 400 installed above said support leg 100.

The support leg 100 comprises front and rear support members 12 and 13 at a front and rear side of a crossbar 11 that is centered thorough the front and rear support members 12 and 13. Casters 15 are provided at lower ends of the front support members 12.

The seat plate 200 comprises an upper seat 21, a lower cover 22 and .a coupler 23, wherein the coupler 23 is located between the upper seat 21 and the lower cover 22 and wherein the crossbar 11 is rotatably coupled to the coupler 23. The coupler 23 includes upper and lower brackets 26 and 26', each of which forms a semi-circular coupling groove. The semi-circular coupling grooves of the brackets 26 and 26' form a circular space therein when they are opposed to each other. The brackets 26 and 26' are formed with long-guide holes 27 and 27', respectively, in a rotational direction of the crossbar 11. The crossbar 11 is formed with protrusions 120 and 120', which is inserted into the long-guide holes 27 and 27', respectively (FIGS. 4, 5A, 5B and 6). Accordingly, the seat plate 200 may be folded/unfolded between the horizontal and the vertical position, wherein the folding and unfolding action is guided by and the protrusions 120 and 120' inserted in the long-guide holes 27 and 27'. Here, the lower cover 22 may be formed with coupling holes (not shown) at either side thereof to be inserted by the crossbar 11. Also, the lower cover 22 may be formed with coupling portions (not shown) at a lower part thereof to selectively receive a rotary-type leg member for use.

Figure 6:
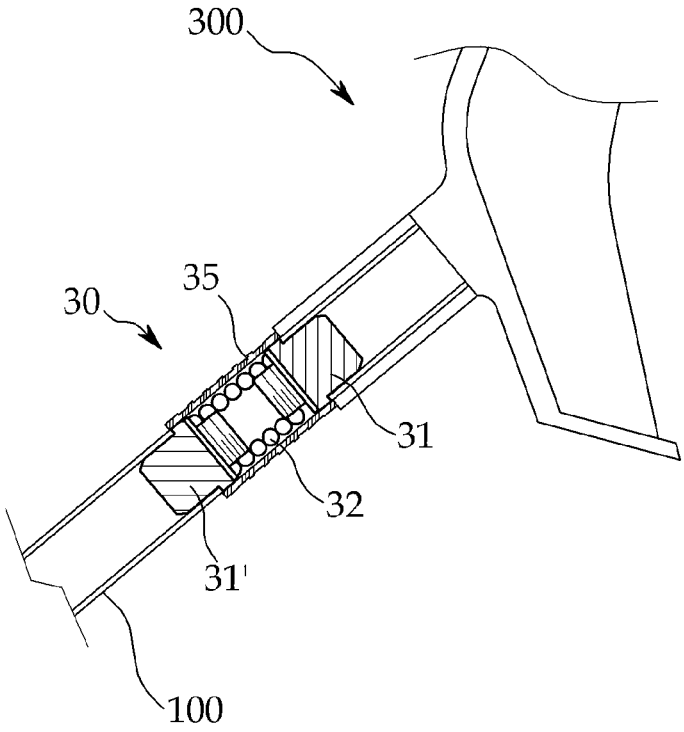
FIG. 6 is a sectional view of tilting means included in the chair according to the embodiment of the present invention.

The back 300 is connected to the support leg 100 through tilting means 30 so to be tilted forward and rearward. As illustrated in FIG. 6, the tilting means 30 includes; an upper connector 31 connected to the back 300; a lower connector 31' connected to the support leg 100; and a tension spring 32 connected between the upper and lower connectors 31 and 31'. A rubber cover 35 covers the upper and lower connectors 31 and 31' and the tension spring 35 for finishing.

Here, the upper and lower connectors 31 and 31' and the tension spring 32 are connected to each other in a thread-coupling manner.

The back 300 may have many different types, such as a plastic back, a fabric or leather back, or a mesh-type back.

Figure 7:
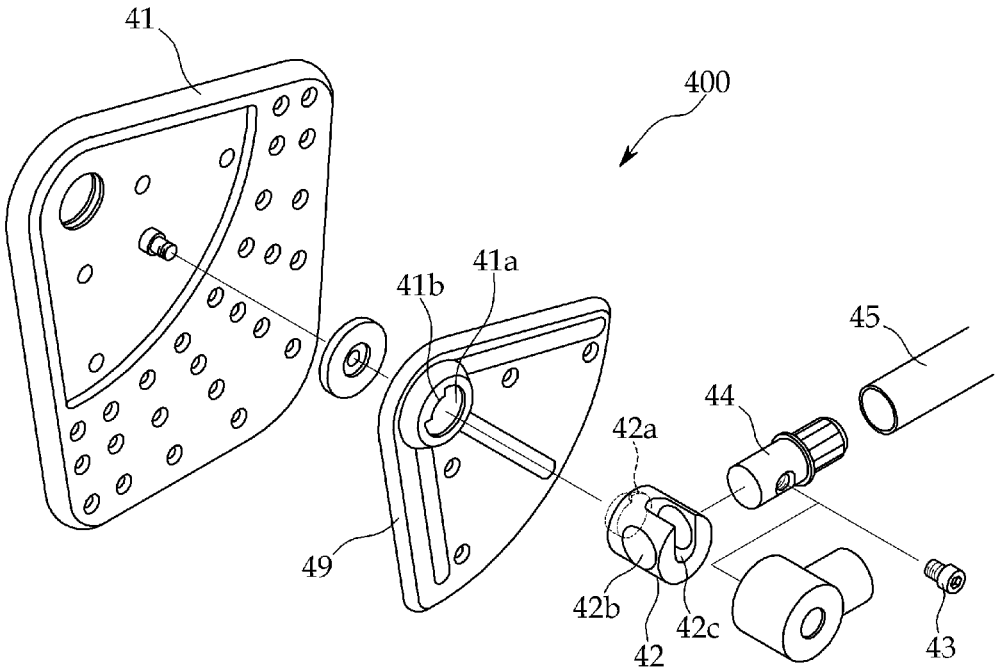
FIG. 7 is an exploded view of the desk included in the chair according to the embodiment of the present invention.
Figure 8:
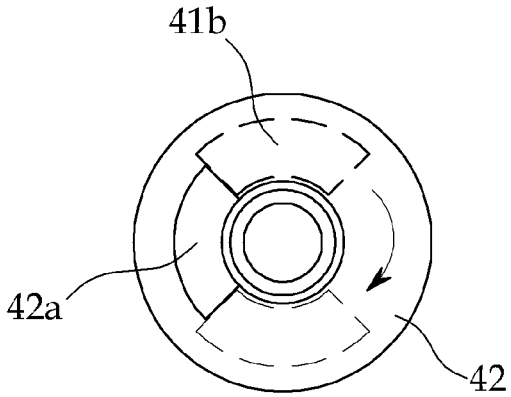
FIG. 8 is a top view of a joint included in the chair according to the embodiment of the present invention.
Figure 9:
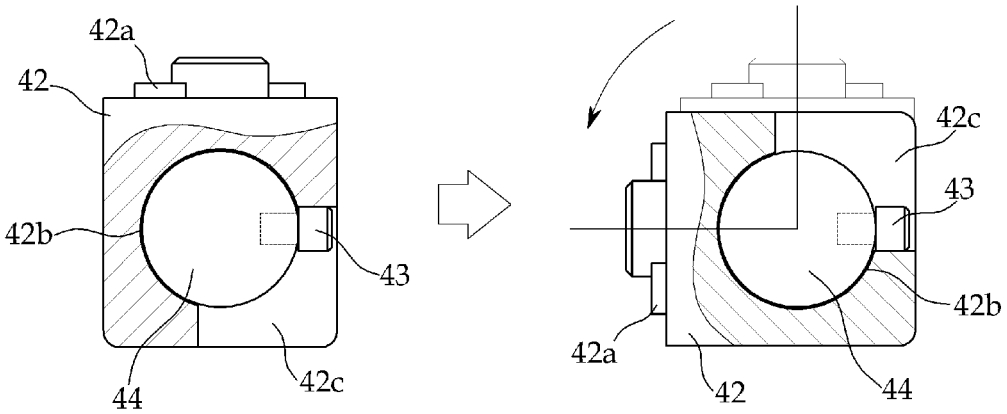
FIG. 9 is a sectional view of the joint coupled to a coupler included in the chair according to the embodiment of the present invention.

As illustrated in FIGS. 7 and 8, an attachment member 49 is provided at a lower side of an upper plate 41, wherein the attachment member 49 is formed with a coupling hole 41*a* on a bottom face thereof and a stop boss 41*b* within the coupling hole 41*a*. The stop boss 41*b* protrudes inwardly from an inner periphery of the coupling hole 41*a* in a radial direction, and partially extends in a circumferential direction. A joint 42 is provided, which is formed with a support boss 42*a* at its top portion. The support boss 42*a* of the joint 42 is inserted into the coupling hole 41*a* of the attachment member 49 to thereby enable the support boss 42*a* to rotate in the coupling hole 41*a*. Here, the rotation of the support boss 42*a* within the coupling hole 41*a* is limited when the support boss 42*a* contacts the stop boss 41*b* depending on a rotational position of the upper plate 41. The upper plate 41 may rotate on a horizontal plane, while its rotation is restricted when the support boss 42*a* contacts the support boss 41*b*.

As illustrated in FIG. 7, the joint 42 has a cylindrical shape which has a cylindrical surface, the top portion and a bottom portion. The joint 42 is formed with a assembling hole 42*b* and an operating hole 42*c*, wherein the assembling hole 42*b* communicates with the operating hole 42*c*. The assembling hole 42*b* is formed to penetrate the cylindrical surface of the joint 42, whereas the operating hole 42*c* extends along the bottom portion and a portion of the cylindrical surface of the joint 42. As described above, the top portion of the joint 42 is blocked so as to make the support boss 42*a* formed at the top portion of the joint 42.

Figure 2:
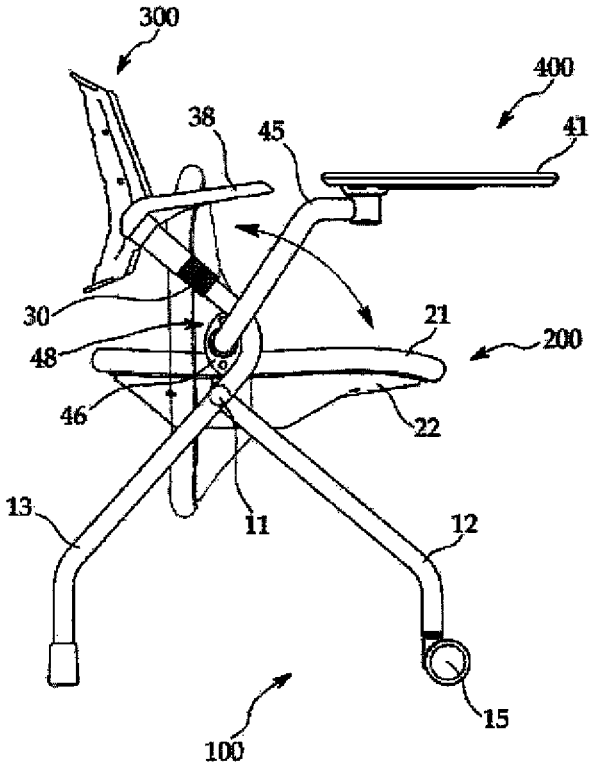
FIG. 2 is a side view of the chair according to an embodiment of the present invention.
Figure 3:
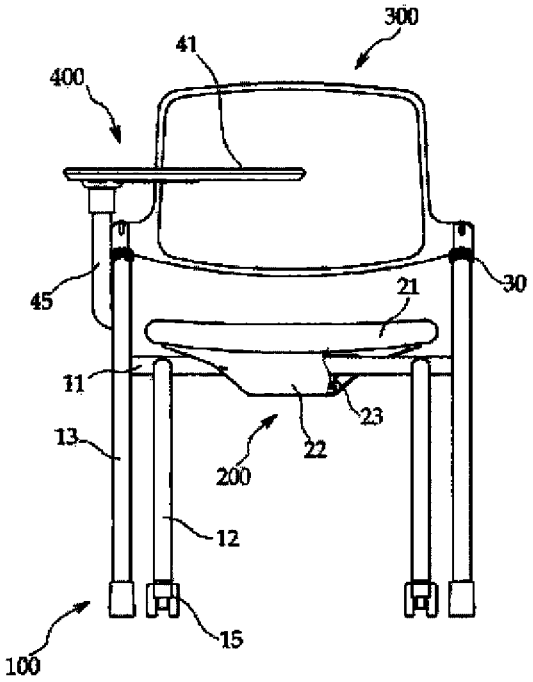
FIG. 3 is a front view of the chair according to the embodiment of the present invention.
Figure 4:
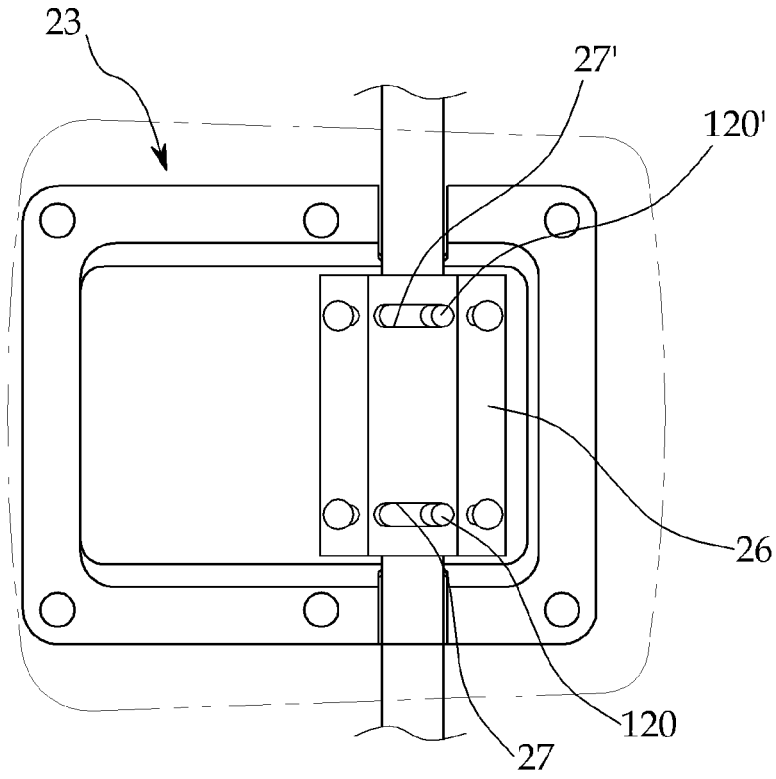
FIG. 4 is a bottom view of a seat plate included in the chair according to the embodiment of the present invention.
Figure 5A:
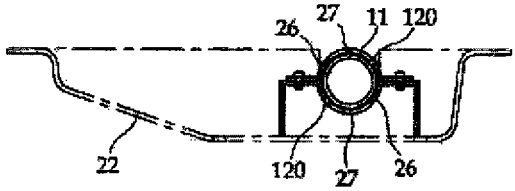
FIG. 5A is a first sectional view illustrating a first operating state of the seat plate according to an embodiment of the present invention.
Figure 5B:
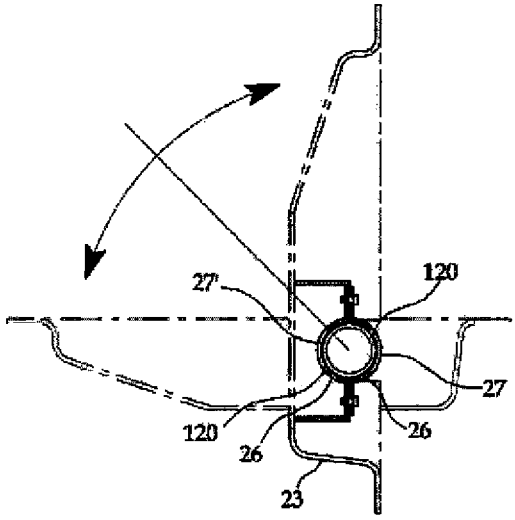
FIG. 5B is a second sectional view illustrating a second operating state of the seat plate according to an embodiment of the present invention.

A coupler 44 serves to connect a connecting bar 45 to the joint 42, wherein the connecting bar 45 is connected to the support member 13 as illustrated in FIG. 2. The coupler 44 is inserted into the assembling hole 42*b* of the joint 42 so as to allow the joint 42 to swing about the coupler 44. A bolt 43 is inserted into the operating hole 42*c* of the joint 42 and then is screwed to the coupler 44. Thereby, while the joint 42 swings about the coupler 44, the bolt 43 may contact either limit of the assembling hole 42*b*. Thus, the swing of the joint 42 is restricted within a certain angle range that is defined by the interaction between the joint 42 and the bolt 43. As a result, the swing of the upper plate 41 coupled to the joint 42 through the attachment member 49 is restricted with the same angle range.

Figure 12:
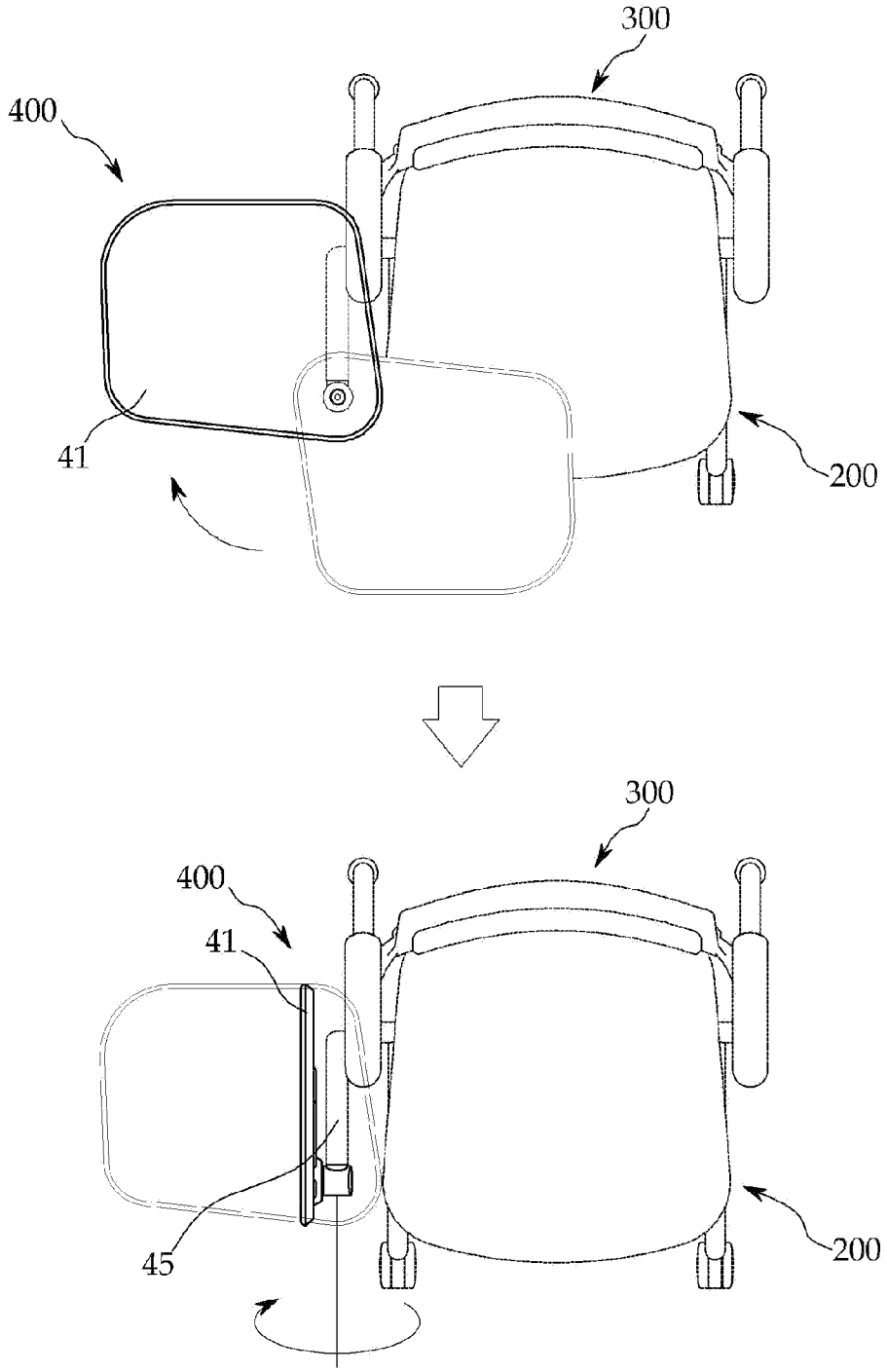
FIG. 12 is a top view of the chair according to the embodiment of the present invention, which illustrates the operation of the desk.
Figure 13:
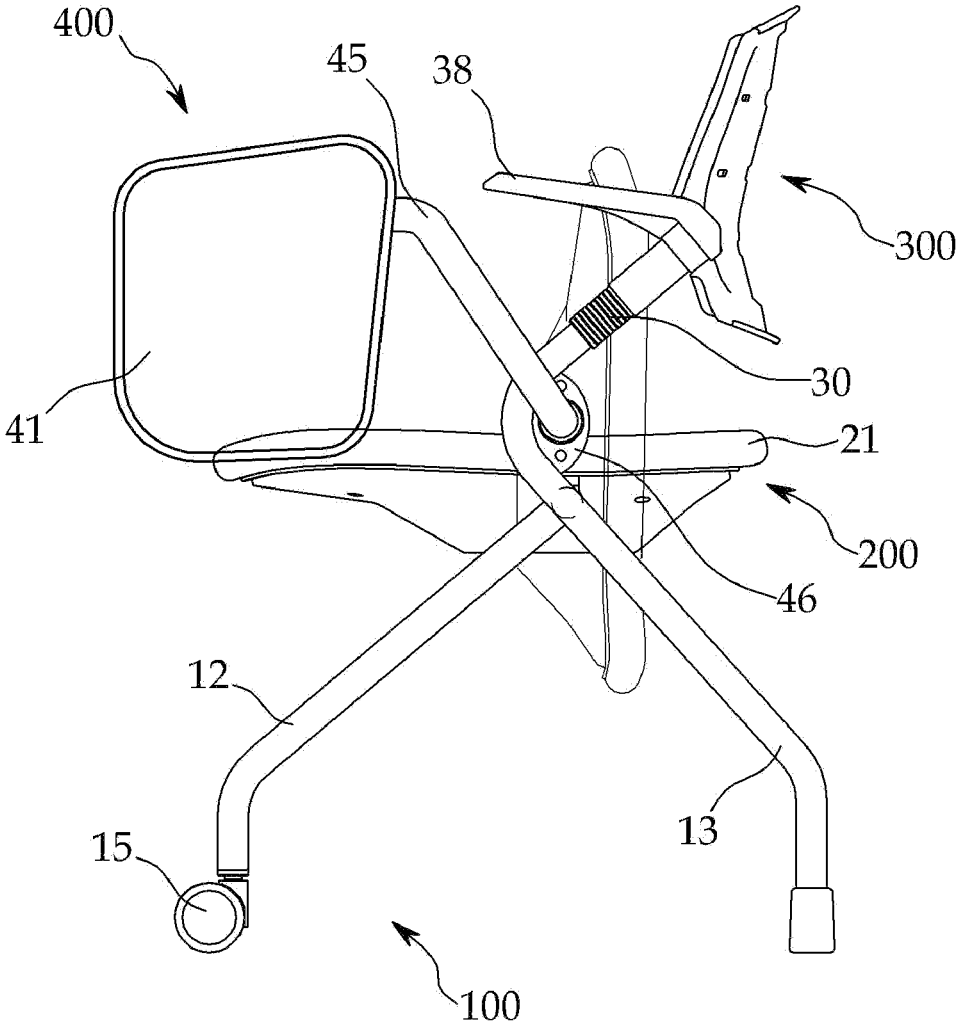
FIG. 13 is a side view of the chair according to the embodiment of the present invention, which illustrates the desk folded near to the chair.

Specifically, the upper plate 41 of the desk 400 may swing between an upper position and a lower position within the angle range between 0 and 90°, as illustrated in FIG. 13, while it may rotates on the horizontal plane within an angle range between 0 and 180°, as illustrated in FIG. 12. Thereby, the upper plate 41 may be folded near to a side of the support member 13.

Figure 10:
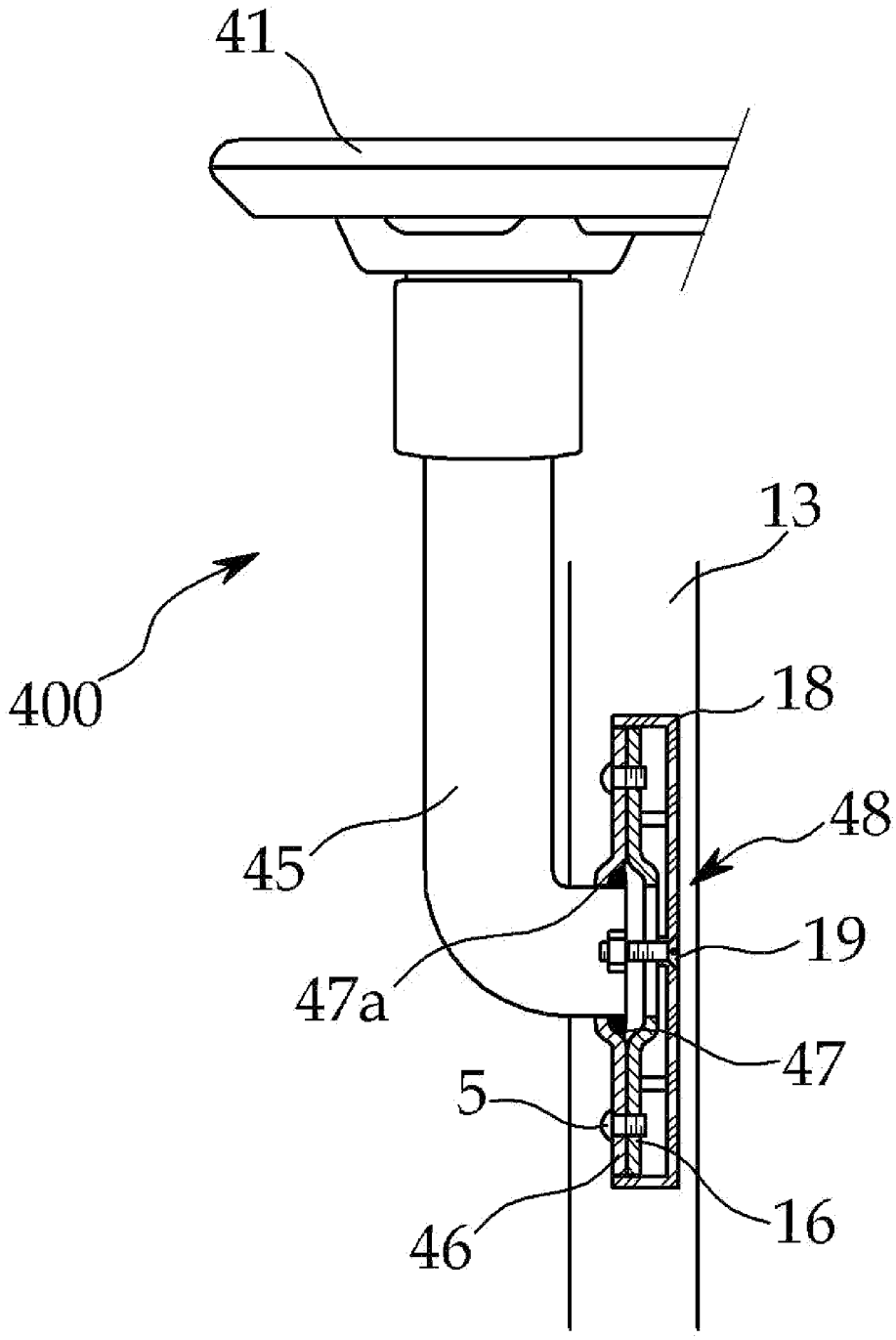
FIG. 10 is a partial section view of the desk included in the chair according to the embodiment of the present invention.
Figure 11:
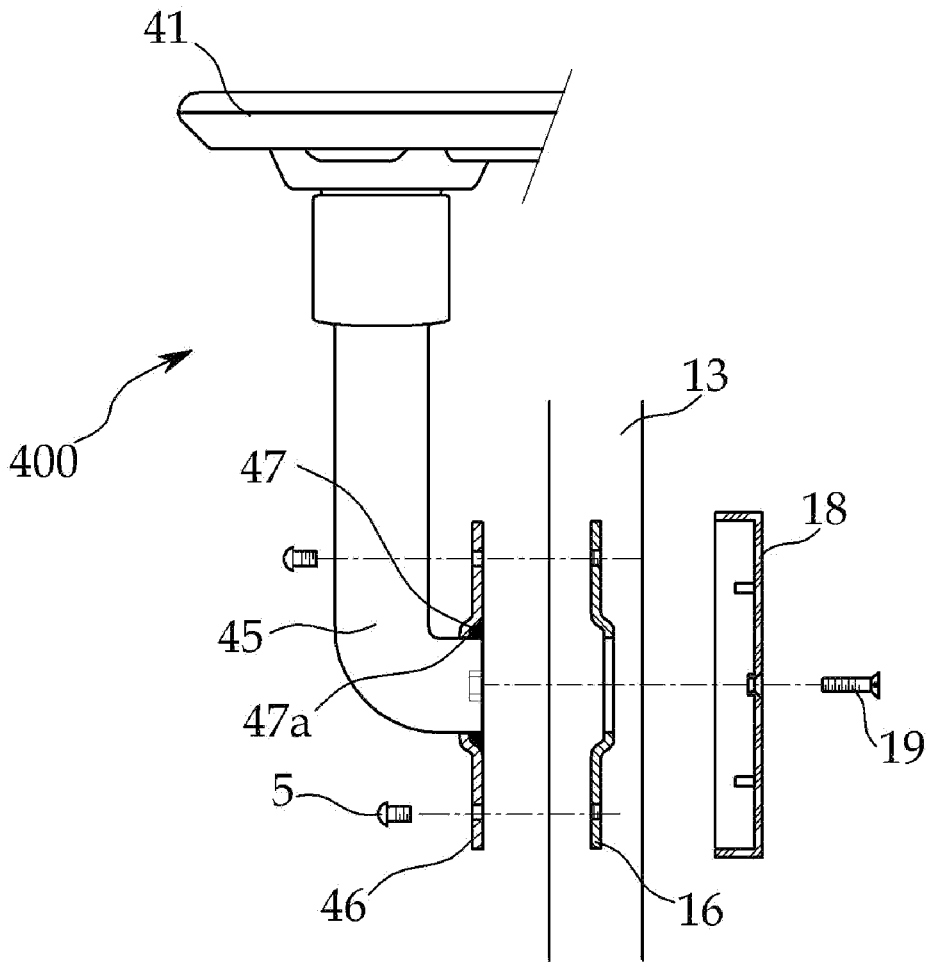
FIG. 11 is an exploded view of a coupling bracket for securing the desk included in the chair according to the embodiment of the present invention.

Further, the desk 400 is connected to the support member 13 in such a way that a coupling bracket 46 connected to an end of the connecting bar 45 is detachably connected to a fixing bracket 16 welded to a bent portion 48 of the support member 13 by means of bolts 5 as illustrated in FIG. 10. The bent portion 48 is formed to have '>' shape at a rear side of the support member 13 as illustrated in FIG. 2.

Here, the coupling bracket 46 allows an end of the connecting bar 45 to pass through a center hole 47*a* of an inner recess 47 to thereby make the end of the connecting bar 45 and the coupling bracket 46 welded together as illustrated in FIG. 10.

A finishing cover 18 is provided outside of the fixing bracket 16 to enclose the fixing bracket 16, so that the finishing cover 18 is assembled by means of bolts and nuts, which are used for the coupling bracket.

Here, a bolt 19 used for fixing the finishing cover 18 is illustrated in FIG. 10; armrests 38 are illustrated in FIG. 1; and the case 46 is illustrated in FIG. 10.

The operation of the invention will be detailed herein below.

The chair according to the present invention makes it possible to rotate the seat plate 200, so that it is folded/unfolded between the horizontal position and the vertical position with the simple structure.

Specifically, when rotating the seat plate 200 to the horizontal or vertical position, the coupler 23 within the seat plate 200 rotates about the crossbar 11 of the support leg 100.

Here, the protrusions 120 and 120' formed on the crossbar 11 are inserted in the long-guide holes 27 and 27' formed through the upper and lower brackets 26 and 26' of the coupler 23 to be guided therein. Thereby, the rotation of the coupler 23 about the crossbar 11 is limited within a certain angle range.

As described above, it is possible to rotate the seat plate 200 to be folded/unfolded between the horizontal position and the vertical position by means of the rotation of the coupler 23. Thus, when carrying or storing the chair, the availability of front/rear space of the chair may be enhanced by folding the seat plate 200.

Also, the chair according to the present invention enables the back 300 to be tilted forward and rearward using the tilting means 30 with the simple structure.

Specifically, the tension spring 32 is installed between the upper connector 31, which is connected to the back 300, and the lower connector 31', which is connected to the support leg 100. Also, the rubber cover 35 encloses the exterior of the tension spring 32 and the connectors 31 and 31'. Thereby, the external force exerting on the back 300 can be buffered by the tension of the tension spring 32 while permitting the back 300 to be tilted. As a result, it is possible to provide the user with the higher comfort.

Further, the chair according to the present invention enables the desk 400, which is located above the support leg 100, to be used in a foldable manner and to be conveniently removed from the chair when it is needed.

Specifically, the attachment/the removal of the desk 400 to/from the chair is available in a convenient manner by screwing/unscrewing the bolts 5 between the connecting bracket 46 connected at the end of the connecting bar 45, and the fixing bracket 16 welded to the bent portion 15, which has the ">" shape at the rear side of the support leg 13. Thus, the better availability of the space can be provided during carriage and storage.

Furthermore, the desk 400 can be used in a folded or unfolded state.

Specifically, when rotating the upper plate 41 about the joint 42 on the horizontal plane, the support boss 42*a* formed at the top of the joint 42 is rotated within the coupling hole 41*a* until it abuts the stop boss 41*a*. Accordingly, the rotation of the upper plate 41 is made with the angle range defined by the engagement between the support boss 42*a* and the stop boss 41*a*. For instance, the upper plate 42*a* may rotate within the angle range of 180°.

When rotating the upper plate 41 upward or downward, the upper plate 41 is rotated about the coupler 44 inserted into the assembling hole 42*b* of the joint 42. Here, the stop bolt 43 is inserted through the operating hole 42*c* to be screwed to the coupler 44. Accordingly, the upper plate 41 rotates upward or downward within an angle range of 90° that is defined by guiding the stop bolt 43 in the operating hole 42*c*.

Therefore, the desk 400 may be folded to contact the side of the chair as illustrated in FIG. 13.

If it is intended to unfold the desk 400 for use, the operation should proceed in a reverse order. In other word, the desk 400 swings upward with the angle range of 90° and then rotates to an original position with the angle range of 180° for use.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A chair with foldable desk, comprising:

a support leg having a crossbar;

a seat plate installed above said support leg and including an upper seat, a lower cover and a coupler into which the crossbar is rotatably inserted, wherein the coupler is formed by upper and lower brackets, each of which has a semi-circular coupling groove to form a circular space for receiving the crossbar, wherein the coupler is formed with long-guide holes extended in a rotational direction of the crossbar to receive support protrusions and formed on the crossbar, and wherein the seat plate rotates between a vertical position and a horizontal position so as to be folded and unfolded;

a back installed above a rear side of the seat plate and capable of tilting forward and rearward by tilting means, wherein the tilting means comprises a tension spring between upper and lower connectors and, which are connected to the back and the support leg, respectively; and a desk installed above a side of the support leg and including an upper plate with an attachment member on its bottom, wherein the attachment member is formed with a coupling hole and a stop boss extending along a portion of an inner periphery of the coupling hole, wherein a joint formed with a support boss is inserted into the coupling hole to rotate therein, wherein the rotation of the joint is limited by the contact between the stop boss and the support boss to thereby limit the rotation of the upper plate on a horizontal plane, wherein the joint is formed with an assembling hole penetrating a cylindrical surface of the joint and an operation hole extending along a bottom and a portion of the cylindrical surface of the joint, wherein an end of a coupler is inserted into the assembling hole of the joint so as to allow the joint to rotate about the coupler, while the other end of the coupler is connected to a connecting bar coupled to the support leg, wherein a stop bolt is inserted through the operating hole to be screwed to the coupler, so that the upper plate may swing between an upper position and a lower position within an angle range defined by the stop bolt that is guided along the operating hole.

2. The chair with the foldable desk as claimed in claim 1, wherein the desk is detachably coupled to the chair in such a manner that a coupling bracket connected to an end of the connecting bar is releasably secured to a fixing bracket welded to a bent portion by bolts, wherein the bent portion has a sideways v-shape and is located at a rear side of the support leg.

* * * * *